US008678529B2

(12) United States Patent
Li

(10) Patent No.: US 8,678,529 B2
(45) Date of Patent: Mar. 25, 2014

(54) DRAWER RAIL ASSEMBLY

(76) Inventor: Shaohan Li, Guangzhou (CN)

( * ) Notice: Subject to any disclaimer, the term of this patent is extended or adjusted under 35 U.S.C. 154(b) by 442 days.

(21) Appl. No.: 12/983,595

(22) Filed: Jan. 3, 2011

(65) Prior Publication Data

US 2011/0188788 A1 Aug. 4, 2011

(30) Foreign Application Priority Data

Feb. 1, 2010 (CN) ..... 2010 1 0105597

(51) Int. Cl.
*A47B 88/04* (2006.01)

(52) U.S. Cl.
USPC ..... 312/334.6; 312/334.9; 312/334.37

(58) Field of Classification Search
USPC ..... 312/330.1, 334.1, 334.6, 334.7, 334.8, 312/334.9, 334.11, 334.12, 334.14, 334.15, 312/334.17, 334.18, 334.25, 334.33, 312/334.37, 334.38, 334.39; 384/18, 19, 20
See application file for complete search history.

(56) References Cited

U.S. PATENT DOCUMENTS

| | | | | |
|---|---|---|---|---|
| 2,960,376 | A * | 11/1960 | Myers | 312/334.11 |
| 5,769,518 | A * | 6/1998 | Grabher | 312/334.6 |
| 6,854,817 | B1 * | 2/2005 | Simon | 312/334.6 |
| 7,296,863 | B2 * | 11/2007 | Lam et al. | 312/334.6 |
| 8,277,003 | B2 * | 10/2012 | Milligan et al. | 312/334.6 |
| 2003/0197452 | A1 * | 10/2003 | Kung | 312/334.6 |
| 2007/0080616 | A1 * | 4/2007 | Lam et al. | 312/334.6 |
| 2009/0238503 | A1 * | 9/2009 | Liang et al. | 384/18 |

* cited by examiner

*Primary Examiner* — James O Hansen
(74) *Attorney, Agent, or Firm* — Hamre, Schumann, Mueller & Larson, P.C.

(57) ABSTRACT

The drawer rail assembly is belonging to the field of furniture. This invention includes fixed rail, intermediate rail, outer pull-out rail, the first retainer and the second retainer. The outer pull-out rail has the first bending part and the second bending part. There are third bending part and forth bending part in the intermediate rail's vertical plane. There is a first ball bearing between the first bending part and the third bending part. There is a second ball bearing between the second bending part and the forth bending part. This invention ensures comprehensive supports among rails, reducing potential gaps to the minimum, improving the feeling to pull and push drawer. It adapts to be set in any furniture.

6 Claims, 7 Drawing Sheets

Prior Art

DRAWER RAIL ASSEMBLY

TECHNOLOGY FIELD

This invention belongs to the area of furniture. Particularly it can bring a smooth feel for people to drag the drawer in its three storeys structure rail.

BACKGROUND OF THE INVENTION

Ordinary drawers have a outer pull-out rail, intermediate rail and a fixed rail. The outer pull-out rail can glide in the intermediate rail, and the intermediate rail can glide in the fixed rail. Because drawer's rails support mostly vertical and downward pressure from drawer, designers focus on devising upward supporting structure. Designers set several horizontal rollers to support rails to move smoothly when the drawer is heavy. These rollers are set between the outer pull-out rail's horizontal plane and the intermediate rail's horizontal plane. And they also be set between the intermediate rail's horizontal plane and the fixed rail's horizontal plane. However, the three rails, particularly the outer pull-out rail and the intermediate rail will become cantilever structure when drawer is being pulled. At this time, the front part of outer pull-out rail will sag, and the end of the outer pull-out rail will hold up. Although some baffles and idler wheels can be set to lock the neighbouring intermediate rail to decrease above phenomenon, these measures still cannot solve issue completely and cannot satisfy customers' excelsior requirement. Besides, people also find that we cannot control exactly for the gaps' breadth wise shaking which is between the outer pull-out rail and intermediate rail or between the intermediate rail and fixed rail. People will feel the drawer having an additional trend to run to right and left when they drag the drawer. It is not what a high-end product customer expects.

All appearance, the disadvantages of today's products need to be improved.

SUMMARY OF THE INVENTION

The aim of this invention is to provide a three storeys drawer structure which is smooth to open and close, avoiding generation of hindered gap.

This invention includes fixed rail, intermediate rail and outer pull-out rail. Both intermediate rail and outer pull-out rail have horizontal planes and vertical planes which are set in horizontal planes' two sides. Between the fixed rail and intermediate rail, there is a first retainer. A first roller being set horizontally and a second roller being set vertically are both in the first retainer. The first roller and second rother each both contact to the fixed rail's surface, and the intermediate rail's surface. A second retainer is in the middle between the intermediate rail and the outer pull-out rail. A third roller being set horizontally is in the second retainer. Besides, the third roller is connecting to the intermediate rail's horizontal surface and the outer pull-out rail's horizontal inner surface. Its characteristics are that a first bending part and a second bending part are in the outer pull-out rail's vertical plane. The first bending part is set in the border between outer pull-out rail's horizontal plane and outer pull-out rail's vertical plane; the second bending part is in the end of outer pull-out rail. There are third bending part and forth bending part setting in the intermediate rail. The third bending part is in the border between the intermediate rail's horizontal plane and the intermediate rail's vertical plane, and it also opposites the outer pull-out rail's first bending part. The forth bending part is below the third bending part and opposites the outer pull-out rail's second bending part. There is a first roller embedding between the first bending part and the third bending part. Furthermore, a second roller is embedding between the second bending part and the forth bending part. Both first roller and second roller are restricted by the second retainer.

To improve the invention, the first bending part of the outer pull-out rail is a bevel edge to connect outer pull-out rail's horizontal plane and outer pull-out rail's vertical plane. The second bending part of the outer pull-out rail bends to outer pull-out rail's inner side. The third bending part of the outer pull-out rail is a bevel edge to connect the intermediate rail's horizontal plane and the forth bending part. The beginning of the forth bending part in the intermediate rail connects smoothly to the end of the third bending part. The end of the forth bending part connects smoothly to the intermediate rail's vertical plane.

To be a preferential structure for this invention, both the second bending part and the forth bending part have arc slide way. The second bending part is two-double bending.

To be a preferential structure for this invention, the first bending part, the second bending part, the third bending part and the forth bending part all have are slide way. The second bending part is a two-double bending.

To be a preferential structure for this invention, the second bending part, the third bending part and the forth bending part all have arc slide way. The second bending part is a two-double bending.

To be a preferential structure for this invention, the forth bending part has arc slide way. Besides, the second bending part is a right angle bending.

The three storeys structure of drawer rail ensures to provide support for slide way in all direction and position, decreasing the potential gaps to minimum level. It meliorates the feeling for people to push and pull the drawer, and it adapts to fix in any furniture.

DETAIL DESCRIPTION

Figure 1:
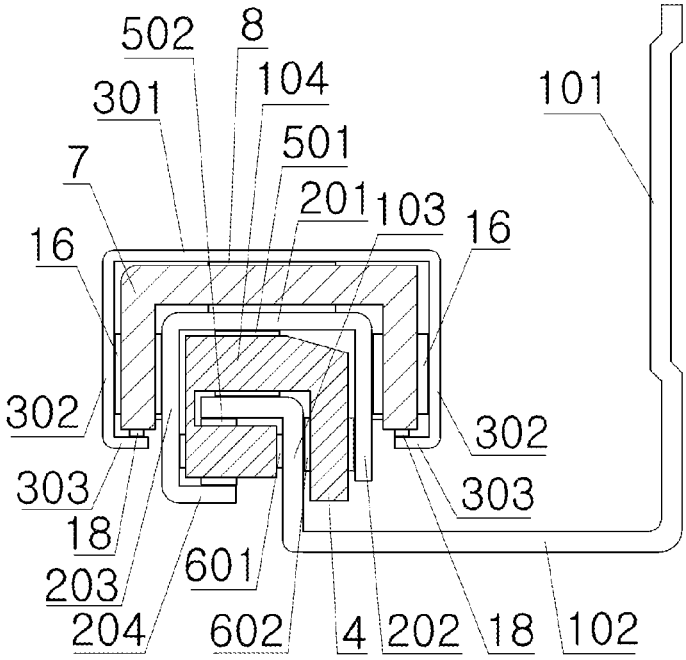
FIG. 1 is a sketch map for drawer structure in existing technology.

The detail description will be presented combining with attached drawing as follow:

Referring to FIG. 1, a traditional drawer has fixed rail, intermediate rail and outer pull-out rail.

Fixed rail has a long vertical plane 101 which is used for fixing. Long vertical plane 101 can extend to a short vertical plane 103 through a horizontal hemline 102. The top of the short vertical plane 103 is bended to be a short horizontal plane 104. The short horizontal plane 104 is used for support pressure from the intermediate rail.

The intermediate rail is a Π figure. It has an upper horizontal plane 201 which can support the pressure from the outer pull-out rail. Upper horizontal plane 201 bends 90 degree to right and left respectively, forming a right vertical plane 202 and a left vertical plane 203. The end of the left vertical plane is bended to form a low horizontal plane 204.

The outer pull-out rail also presents a Π figure. It has a horizontal plane 301 to support the pressure from drawer. Horizontal plane 301 bends 90 degree to right and left respectively, forming two vertical planes 302. The end of two vertical planes 302 bend to inner side, forming a short horizontal plane 303.

The first retainer 4 is between the fixing rail and the intermediate rail and made by plastic. The retainer 4 has a horizontal roller 501 and a nether roller 502, a left vertical roller 601 and a right vertical roller 602. The roller 501 contacts to the short horizontal plane 104's upper surface in fixing rail and the upper horizontal plane 201's nether surface in intermediate rail respectively. The nether roller 502 contacts to the short horizontal plane 104's nether surface in fixing rail and the nether horizontal plane 204's upper surface in intermediate rail respectively. Both left roller 601 and right roller 602 contact to the short vertical plane 103's surface in fixing rail, the left vertical plane 203's surface in middle or the right vertical plane 202's surface in intermediate rail. The two short horizontal planes 303 in outer pull-out rail contact to the roller 18 in intermediate rail's right vertical plane 202 or the roller 18 in intermediate rail's left vertical plane 203 respectively.

The plastic second retainer 7 is between the intermediate rail and the outer pull-out rail. In the second retainer 7, there are the third horizontal roller 8 and two of the forth vertical rollers 16. The third roller 8 contacts to the horizontal plane 301's nether surface in outer pull-out rail and horizontal plane 201's upper surface in intermediate rail. One of the forth rollers 16 contacts to the vertical plane 302's inner surface in outer pull-out rail, the other forth roller 16 contacts to the right vertical plane 202 in intermediate rail, or the left vertical plane 203 in intermediate rail.

According to FIG. 1, in traditional, the upper roller 501 and the third roller 8 are mainly to support the pressure from drawer. The three rails, particularly the outer pull-out rail and the intermediate rail become cantilever structure when drawer is fishing up. The reason for forming the cantilever structure is that the front of outer pull-out rail will sink and the end of outer pull-out rail will rise. Only the roller 18 where is in the short horizontal plane 303 in outer pull-out rail can restrict ending rising at this time. Because the roller 18 is set by a shaft which mounted beside the intermediate rail. It is hard to control the error of parts' size and the error of assembly, it may cause incorrect engagement between the roller 18 and the short horizontal plane 303, causing the issue of rails' uneven moving. Besides, due to the restriction of retainer's width, the third roller 8 cannot extent to an adequate length, causing the two shoulders of outer pull-out rail may sway unsteadily.

Referring to FIG. 2, FIG. 3 and FIG. 7, 8, 9, the embodiment 1 in this invention has fixing rail 1, intermediate rail 2, outer pull-out rail 3, the first retainer 4 and the second retainer 7. The improvement of this invention concentrates on the shape of intermediate rail 2 and outer pull-out rail 3, and the connecting relationship between intermediate rail 2 and outer pull-out rail 3.

The first retainer 4 is set between the fixing rail 1 and the intermediate rail 2. There are two horizontal first rollers 5 and two vertical second rollers 6 in the first retainer 4. Both of the first roller 5 and the second roller 6 contact the fixing rail 1's surface and the intermediate rail's surface respectively.

The second retainer 7 is between the intermediate rail 2 and the outer pull-out rail 3. In the second retainer 7, there is horizontal third roller 8. The third roller 8 contacts to not only the upper horizontal plane's upper surface in intermediate rail 2, but also horizontal plane's nether surface in outer pull-out rail 3.

Figure 4:
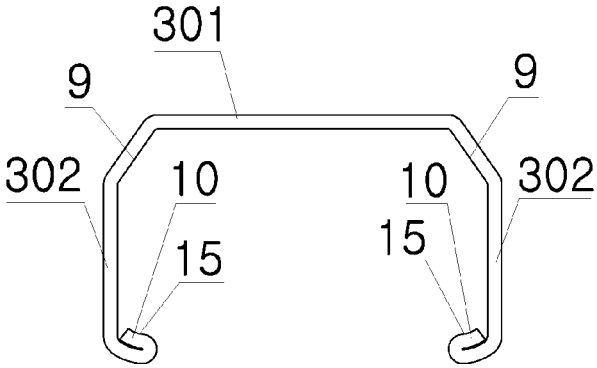
FIG. 4 is a cutaway view for the outer pull-out rail in embodiment 1.

Referring to FIG. 4, the outer pull-out rail has symmetrical sections, including horizontal plane 301 and two vertical planes 302. The outer pull-out rail's two vertical planes 302 have the first bending part 9 and the second bending part 10. The first bending part 9 is the border which is between outer pull-out rail's horizontal plane 301 and outer pull-out rail's vertical plane 302. The first bending part 9 is a bevel edge which links horizontal plane 301 and vertical plane 302. The outer pull-out rail's second bending part 10 which bends from vertical plane 302's ending to outer pull-out rail's inner side. The second bending part 10 is a two-double bending. Arc slide way 15 is processed from the second bending part 10.

Figure 5:
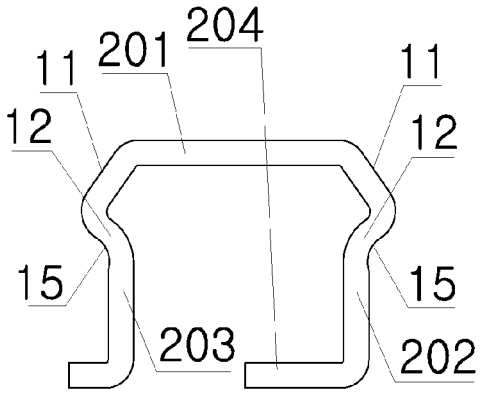
FIG. 5 is a cutaway view for the intermediate rail in embodiment 1.

Referring to FIG. 5, the intermediate rail's section includes upper horizontal plane 201, left vertical plane 203 and right vertical plane 202. The left vertical plane 203 and the right vertical plane 202 have the third bending part 11 and the forth bending part 12 respectively. The third bending part 11 is in the border between the upper horizontal plane 201 and the left vertical plane 203 (or between the upper horizontal plane 201 and the right vertical plane 202). The third bending part 11 is opposites to FIG. 4's first bending part 9. The third bending part 11 is a bevel edge which contacts the intermediate rail's upper horizontal plane 201 and the forth bending part 12. The beginning of forth bending part 12 contacts smoothly to the end of third bending part 11. The end of forth bending part 12 contacts smoothly to the right vertical plane 202 or the left vertical plane 203. The forth bending part 12 is below the third bending part 11 and opposites to the second bending part 10 in FIG. 4. It is processed as arc slide way 15. The end of right vertical plane 202 forms a short horizontal plane 204 which points to the intermediate rail's inner side through a right angle bending.

Figure 2:
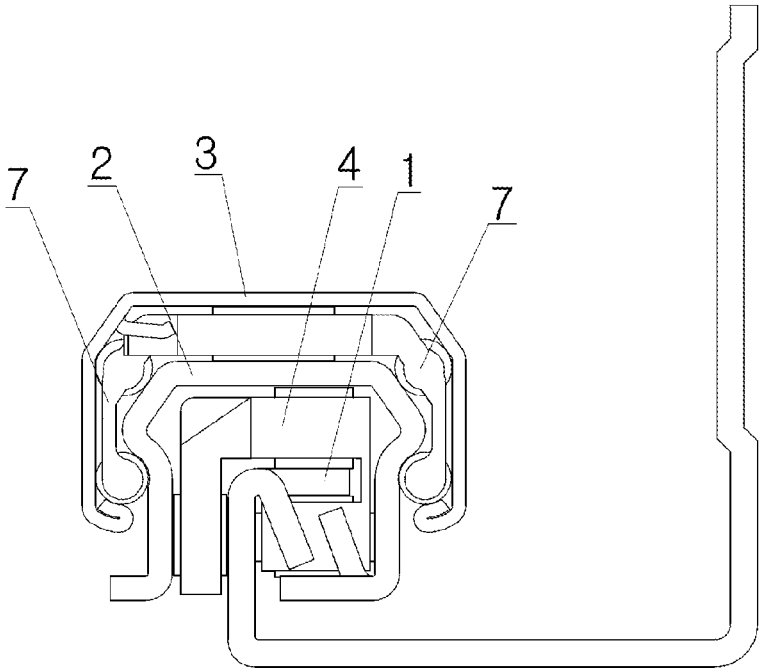
FIG. 2 is a structure drawing for embodiment 1.
Figure 3:
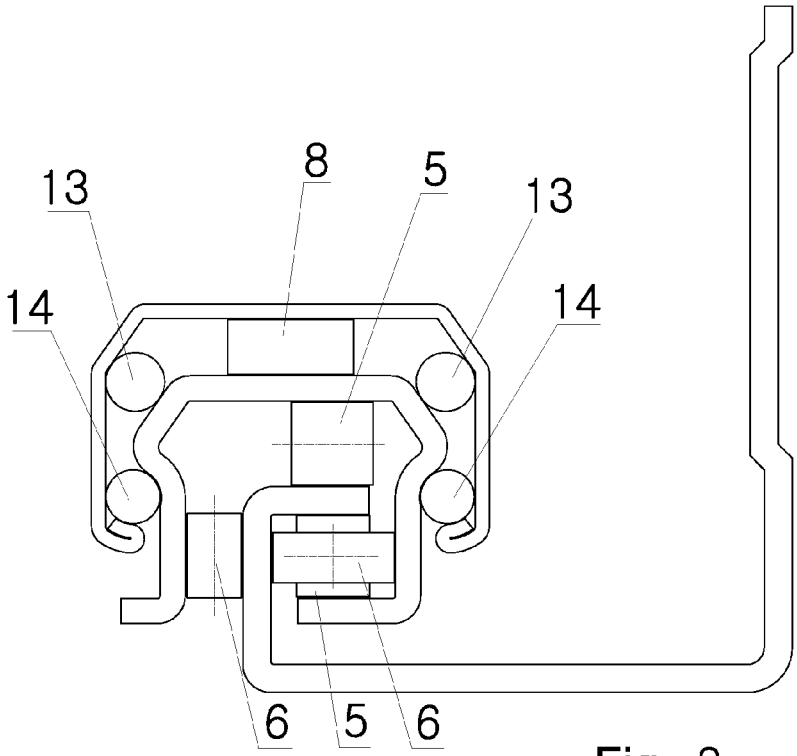
FIG. 3 is a simple structure drawing for embodiment 1 (exclude retainer).
Figure 6:
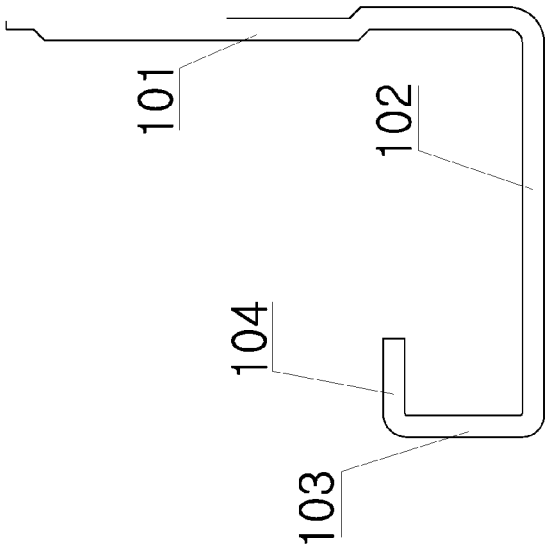
FIG. 6 is a cutaway view for the fixed rail in embodiment 1.
Figure 7:
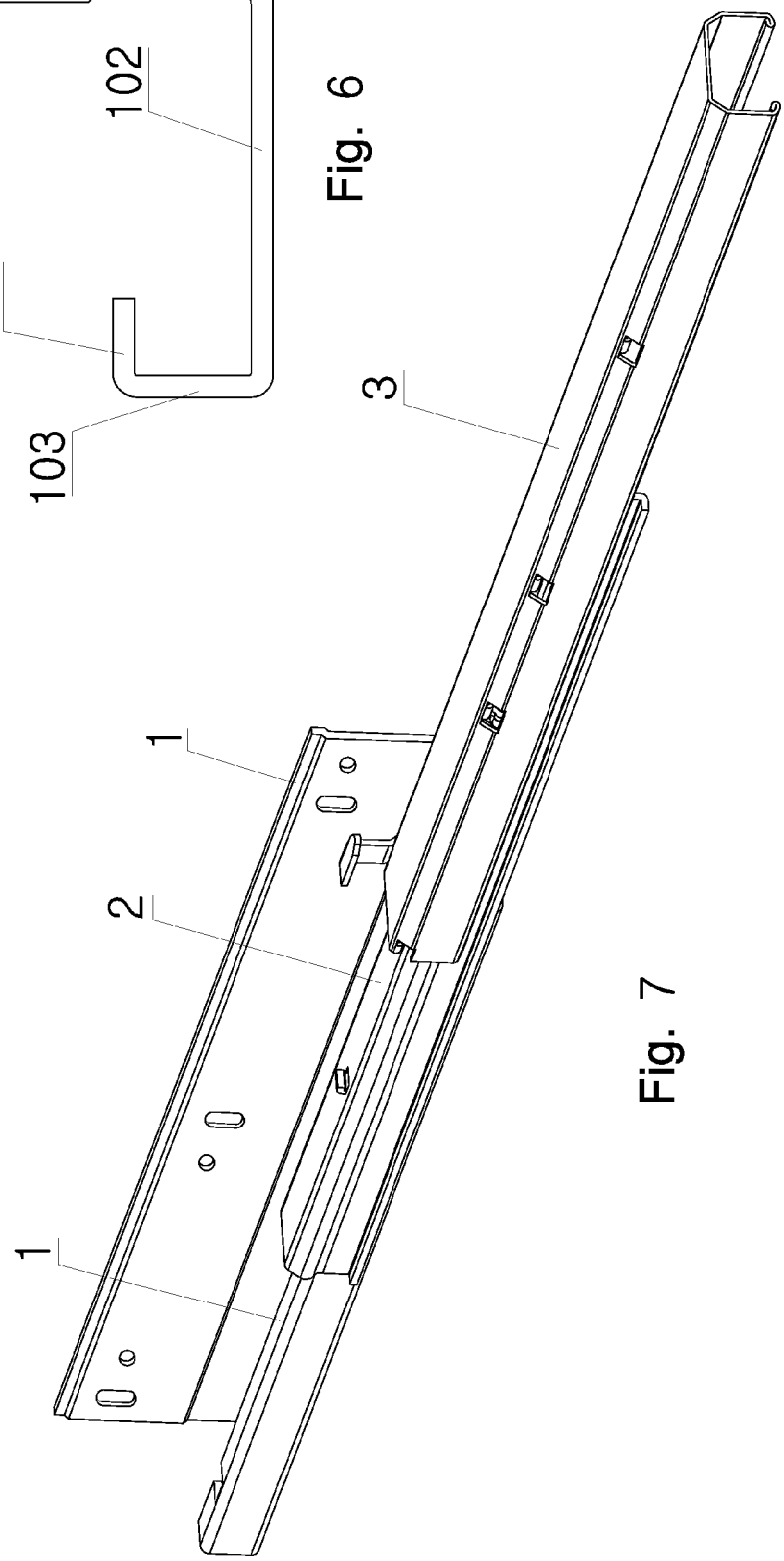
FIG. 7 is an exterior view for embodiment 1.
Figure 8:
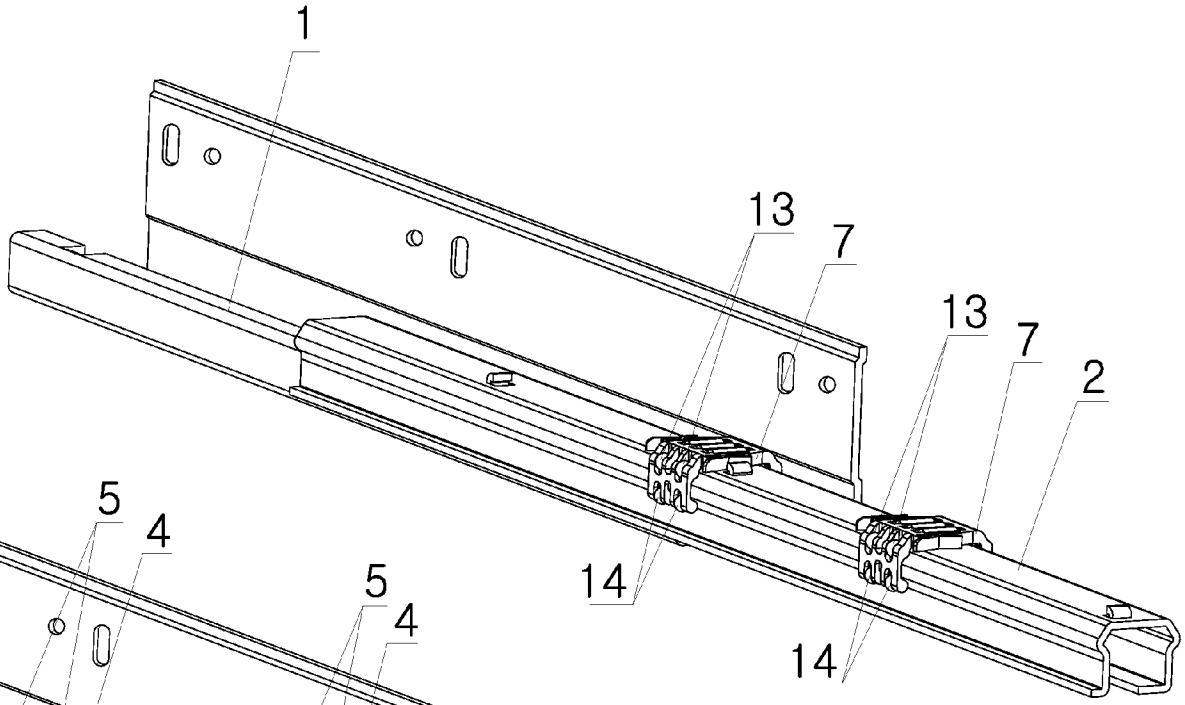
FIG. 8 is an exterior view for embodiment 1 without the outer pull-out rail.
Figure 9:
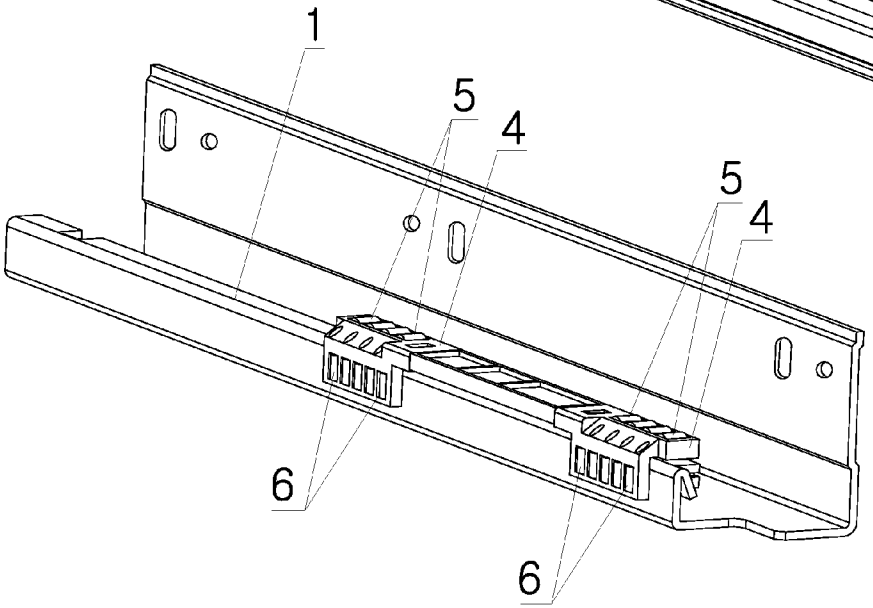
FIG. 9 is an exterior view for embodiment 1 without the outer pull-out rail, the second retainer and the intermediate rail.

Referring to FIG. 2 and FIG. 3, the first ball bearing 13 is set in the outer pull-out rail's left first bending part 9 and right first bending part 9 respectively. Besides, the first roller 13 is also set in the intermediate rail's left third bending part and right bending part respectively. The second ball bearing 14 is set in the outer pull-out rail's left second bending part 10, right second bending part 10, intermediate rail's left forth bending part 12 and right forth bending part 12 respectively (FIG. 3). The second retainer 7 changes the idea of traditional product, extending the length of retainer's two sides, reaching nearly to outer pull-out rail's second bending part 10. Therefore, the two first ball bearing 13 and the two second ball bearing 14 are all restricted by the second retainer 7 (FIG. 2). Referring to FIG. 6, the structure of fixing rail is similarly to the traditional product. The fixing rail has a long vertical plane 101 which is for setting. The bottom of long vertical plane 101 extends to a short vertical plane 103 through a horizontal hemline 102. The top of short vertical plane 103 bends to a short horizontal plane 104. The short horizontal plane 104 is used for supporting the pressure from intermediate rail.

In the presented structure, it has different function of each roller and ball bearing. The first roller 5 and the third roller 8 are used for supporting a plumb and down pressure from drawer. The two ball bearings 14 from right and left are used for resisting any applied force which may cause the outer pull-out rail 3 being off the intermediate rail 2. The right and left ball bearings 13 are used for resisting any applied force which may cause the outer pull-out rail 3 deviating the intermediate rail 2. The second roller 6 is used for resisting any applied force which may cause the intermediate rail 2 deviating the fixed rail 1. From the restricting of all rollers and ball bearings, the three rails can always keep straightforward, no sinking, no leaning, which bring a smoothing and portable feeling to users.

Referring to FIG. 3, in the embodiment 1, the first ball bearing is point-contact to the first bending part and the outer pull-out rail's vertical plane at the same time. Besides, the first ball bearing is also point-contact to the third bending part. What's more, arc slide ways are extruded in the second bending part and the forth bending part. The curvatures of arc slide ways are similar with that of the second ball bearing's surface. It makes the second ball bearing have face-contact to the second bending part, and the second ball bearing has face-contact to the forth bending part.

According to rail product's purpose or standard, we can set the shape of bending part in our demand. Friction can be reduced when the ball bearing is designed as point-contact to the bending part. Intensity of pressure can be decreased and ball bearing's carrying capacity can be improved when it's face-contact between ball bearing and bending part.

Figure 10:
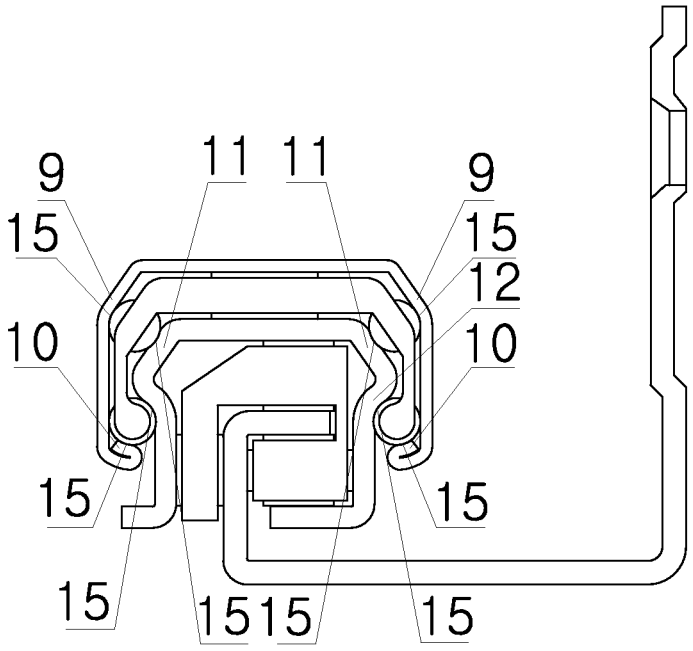
FIG. 10 is a structure drawing for embodiment 2.

Referring to FIG. 10, the difference between embodiment 2 and embodiment 1 is that all of the first bending part 9, the second bending part 10, the third bending part 11 and the forth bending part 12 all have arc slide way 15.

Figure 11:
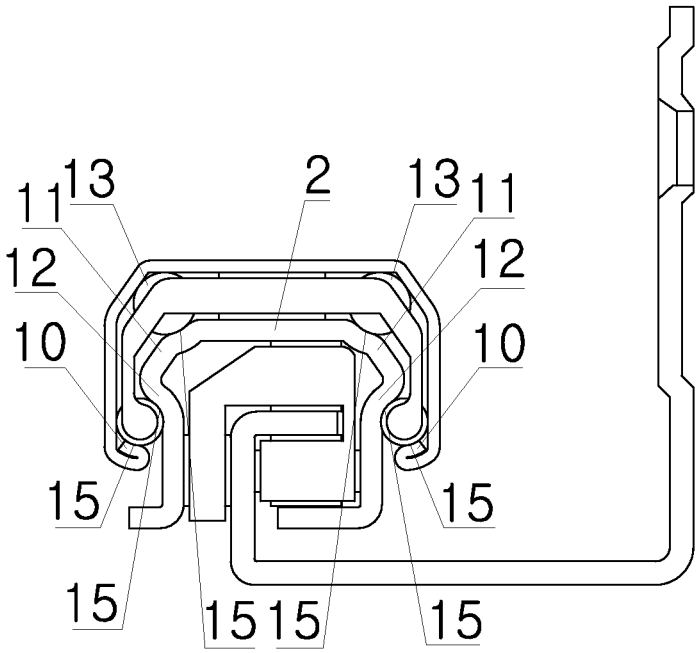
FIG. 11 is a structure drawing for embodiment 3.

Referring to FIG. 11, in the embodiment 3, the second bending part 10, the third bending part 11 and the forth bending part 12 all have arc slide way 15. Besides, the position of the third bending part 11's arc slide way 15 is closer to the upper horizontal plane in the intermediate rail 2. Thereby the position of the first ball bearing 13 is higher than that in the embodiment 1 and embodiment 2.

Figure 12:
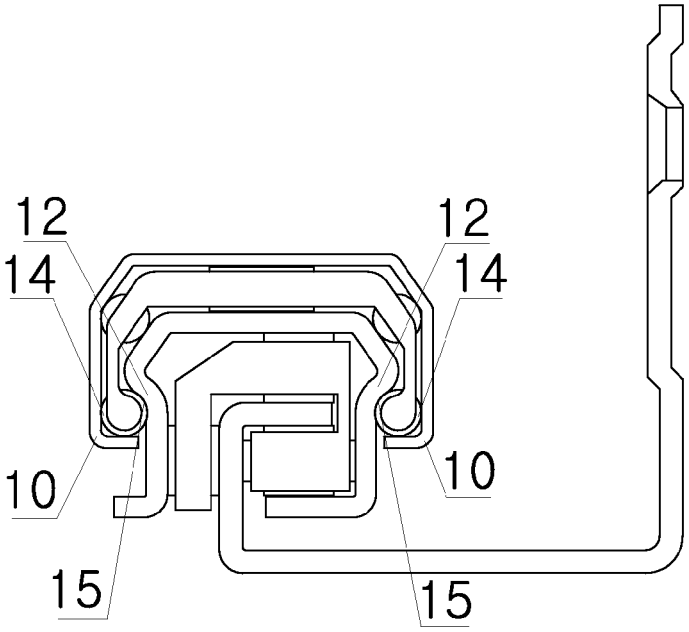
FIG. 12 is a structure drawing for embodiment 4.

Referring to FIG. 12, the different of embodiment 4 and embodiment 1 is that the second bending part 10 is not a two-double bending. The second bending part 10 is a right-angled bending in the ending of the outer pull-out rail's vertical plane, in this way, it forms point-contact between the second bending part 10 and the second ball bearing 14. Only the forth bending part 12 has arc slide way 15.

Figure 13:
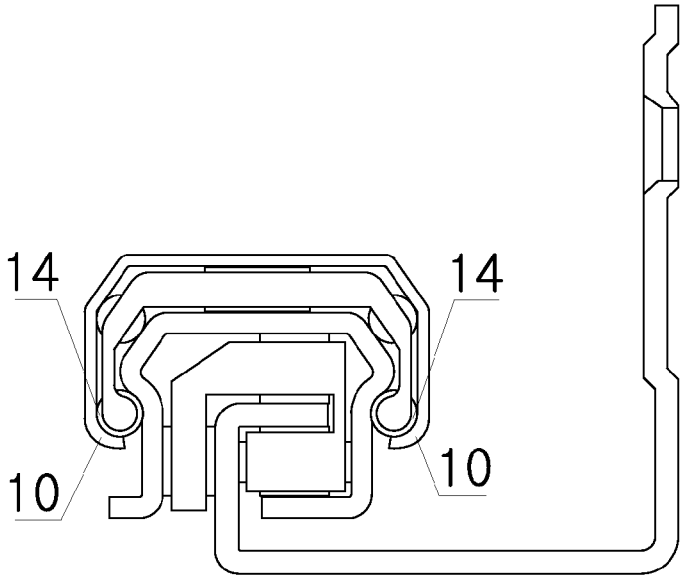
FIG. 13 is a structure drawing for embodiment 5.

Referring to FIG. 13, the difference of embodiment 5 and embodiment 4 is that the second bending part 10 is not a right-angle bending. It is designed as a quarter of cirque and the radii is the same as that of the second ball bearing 14. So the second bending part 10 is face-contact with the second ball bearing 14.

Figure 14:
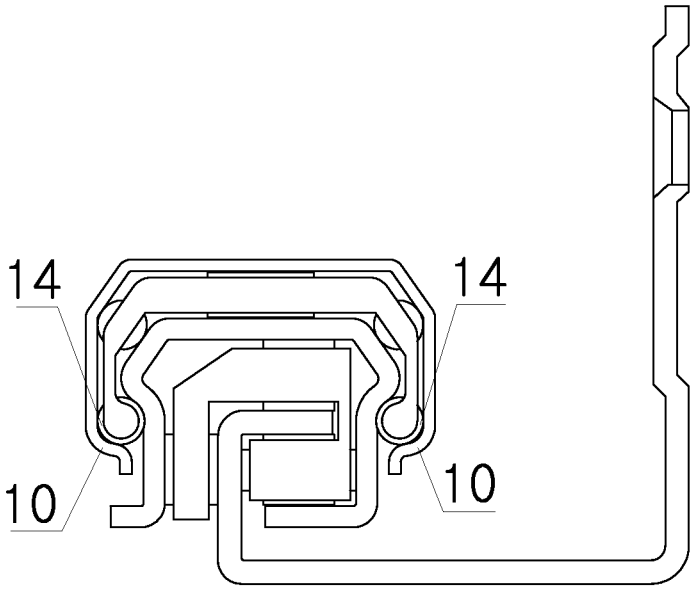
FIG. 14 is a structure drawing for embodiment 6.

Referring to FIG. 14, from the structure of embodiment 6 and embodiment 5, the second bending part 10 has a downward tail, which will not change the face-contact situation with the second ball bearing 14. Designing the downward tail is just for the production craftwork considering.

Figure 15:
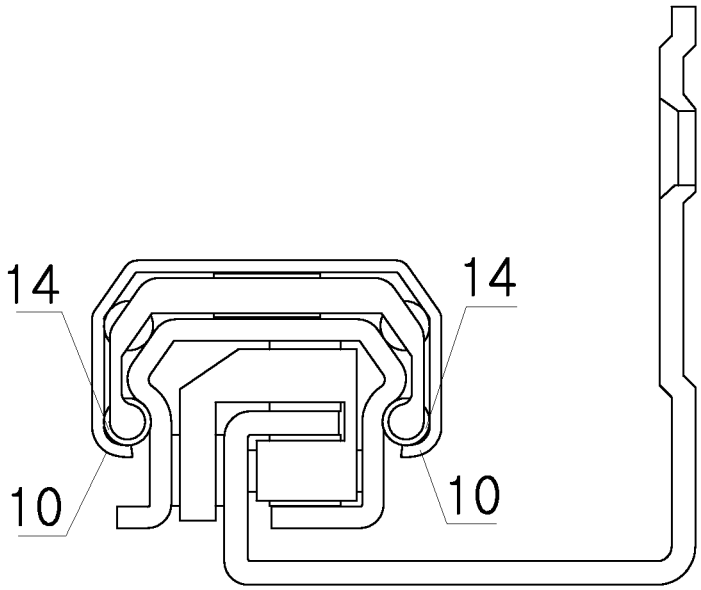
FIG. 15 is a structure drawing for embodiment 7.

Referring to FIG. 15, the difference of embodiment 7 and embodiment 5 is that the second bending part 10 being presented as a shape of curve. The curvature of this curve is less than the second ball bearing 14's surface curvature. In this way, it is a point-contact between the second ball bearing 14 and the second bending part 10.

The above-mentioned embodiments are helpful for us to understand the structure principle of this invention. However, this invention won't debar other embodiments. In contrast, any logical transmutation in this invention's foundational structure should be in this invention's protection area.

What is claimed is:

1. A three-story drawer rail assembly comprising:

a fixed rail;

an intermediate rail; and an outer pull-out rail;

wherein the intermediate rail and the outer pull-out rail both have a horizontal plane and two vertical planes, wherein a first retainer is set between said fixed rail and said intermediate rail, two first rollers are positioned parallel to the horizontal plane, two second rollers positioned perpendicular to the horizontal plane being associated with the first retainer, both said first roller and said second roller contact a surface of the fixed rail and a surface of the intermediate rail, a second retainer being set between the intermediate rail and the outer pull-out rail, a third roller parallel to said horizontal plane being associated with the second retainer, contacting the surface of the intermediate rail and an inner surface of outer pull-out rail, wherein each said vertical plane of the outer pull-out rail has a first bending part and a second bending part, the first bending part is located at a location where the outer pull-out rail's horizontal plane and vertical plane are joined to each other, the second bending part is located at an end of the vertical plane a third bending part and a fourth bending part relate to the vertical plane of the intermediate rail, the third bending part is located at a location where the horizontal plane and vertical plane are joined to each other, opposite to the first bending part of the pull-out rail, the fourth bending part is located below the third bending part, opposite the second bending part of the outer pull-out rail, a first ball being positioned between the first bending part and the third bending part, a second ball being positioned between the second bending part and the fourth bending part, the first ball and the second ball are restricted by the second retainer.

2. The three-story drawer rail assembly of claim 1, wherein first bending part of the outer pull-out rail has a bevel edge that connects a horizontal border of the outer pull-out rail and a vertical border of the outer pull-out rail; second bending part of the outer pull-out rail bends to an inner side of the outer pull-out rail; the third bending part of the intermediate rail has a bevel edge that connects a horizontal border of the intermediate rail and the fourth bending part; a beginning of the fourth bending part connecting with an ending of the third bending part, an end of the fourth bending part being connected with the horizontal border of the intermediate rail.

3. The three-story drawer rail assembly of claim 1, wherein the second bending part and the fourth bending part have an arc slide way; the second bending part has two-double bends.

4. The three-story drawer rail assembly of claim 1, wherein each of the first bending part, the second bending part, the third bending part and the fourth bending part has an arc slide way; the second bending part has two-double bends.

5. The three-story drawer rail assembly of claim 1, wherein each of the second bending part, the third bending part and the fourth bending part have an arc slide way; the second bending part has two-double bends.

6. The three-story drawer rail assembly of claim 1, wherein the fourth bending part has an arc slide way; the second bending part has a right-angle bend.

* * * * *